US005647229A

United States Patent [19]

Conti

[11] Patent Number: 5,647,229

[45] Date of Patent: Jul. 15, 1997

[54] DEVICE FOR CLOSING THE INITIAL END OF A KNITTED ARTICLE SUCH AS A SOCK OR OTHER

[75] Inventor: Paolo Conti, Florence, Italy

[73] Assignee: Golden Lady S.p.A., Ancona, Italy

[21] Appl. No.: 583,087

[22] PCT Filed: May 12, 1995

[86] PCT No.: PCT/IT95/00072

§ 371 Date: Jan. 16, 1996

§ 102(e) Date: Jan. 16, 1996

[87] PCT Pub. No.: WO95/31595

PCT Pub. Date: Nov. 23, 1995

[30] Foreign Application Priority Data

May 17, 1994 [IT] Italy ..... FI94A0088

[51] Int. Cl.[6] ..... D04B 9/56

[52] U.S. Cl. ..... 66/58; 66/148

[58] Field of Search ..... 66/49, 58, 148, 66/187

[56] References Cited

U.S. PATENT DOCUMENTS

| | | | |
|---|---|---|---|
| 1,127,337 | 2/1915 | Williams | 66/58 X |
| 1,192,328 | 7/1916 | Lawson | 66/58 X |
| 1,238,717 | 8/1917 | Scott | 66/58 |
| 1,308,828 | 7/1919 | Williams | 66/58 |
| 1,814,265 | 7/1931 | Schabacker | 66/148 X |
| 1,891,857 | 12/1932 | Williams | 66/148 |
| 3,938,355 | 2/1976 | Conti | 66/187 X |

FOREIGN PATENT DOCUMENTS

| | | |
|---|---|---|
| 0592376 | 4/1994 | European Pat. Off. . |
| 1635992 | 7/1971 | Germany . |
| 676845 | 11/1964 | Italy . |
| 1205775 | 3/1989 | Italy . |
| 1241770 | 2/1994 | Italy . |

*Primary Examiner*—John J. Calvert
*Attorney, Agent, or Firm*—McGlew and Tuttle

[57] ABSTRACT

A push rod (38) with a pick-up hook (38A) at the end is moved in an axial plane of symmetry to engage by means of the pick-up hook in an intermediate position the partial initial courses (M1) of a pocket (M2) and to bring them progressively to the side opposite the arc of working needles with the progressive formation of the fabric; a body in the form of a shaped annular ring (18), disposed inside the needle cylinder, has a radial slot (22) for said push rod (38) and radial slots (24) in the area opposite said arc of working needles; hooks (60) movable in said slots (24) can be moved from a concealed position to a raised position to make pin-shaped appendages (62) penetrate into the fabric along the initial edge (M1) when this has been brought by the push rod (28) to the side opposite that of the arc of working needles, and subsequently to move the initial comes (M1) progressively up to the needles which are raised and inserted into the fabric to engage said edge (M1).

6 Claims, 17 Drawing Sheets f
FK
9
5X
62
M1
62
60
9
22
38A
5
5Y
38
66
58
40
72
56
18
42

DEVICE FOR CLOSING THE INITIAL END OF A KNITTED ARTICLE SUCH AS A SOCK OR OTHER

TECHNICAL FIELD

The invention relates to a process and device for closing the initial end of a tubular article, for example the toe of a sock or other, during formation on a circular knitting machine.

BACKGROUND ART

Processes and devices for obtaining directly on the circula knitting machine a cloesd toe in a sock or the like are disclosed for example in Italian Patent Application n. 9465A/90, filed Aug. 10, 1990 or in Italian Patent Application n. FI 91 A 227, filed Sep. 13, 1991. These known methods and devices did not give satifactory results.

Attempts have been made to close the toe of the stocking directly on the circular knitting machine.

Italian patents n. 676.845 and 685.974 to Giuliano Ugolini disclose the closing of the toe,. Upon completion of the knitted tubular article, by means of,a device which replaces the normal dial plate. It is therefore impossible to knit a double hem, which requires use of the dial hooks.

Italian patent n. 1.205.775 to Schiavello also discloses the closing of the toe upon completion of the tubular article. The transfer of the loops upon closing of the toe should be provided by mechanical members whose functionality is not convincing.

All these prior art devices, moreover, have the drawback of a relatively coarse end (unthread portion) protruding from the article at the toe region.

Italian patent application n. 9465 A/90, filed Aug. 10, 1990 in the name of Conti Florentia and Italian patent application n. FI 91 A 27 filed Sep. 13, 1991 in the name of Bazzanti, disclose an apparatus which allow to begin the working of the article Starting from a closed toe on the same machine on which the article is then completed. These machines have several functional complications which are eliminated by the present invention.

OBJECTS OF THE INVENTION

The object of the invention is to provide a device which ensures ample free space inside the cylinder and correctly transfers the fabric—initially knitted on one arc of needles—to the needles of the complementary arc. These and other objects and advantages will be made clear by the following text.

SUMMARY OF THE INVENTION

The process is designed to close the initial end of a knitted article—such as a sock or other—directly on the circular knitting or stocking machine which can form a portion of fabric in the form of a pocket with narrowing sections and widening sections along an arc of needles of approximately 180° comprising the transfer of the formed fabric to the area opposite said arc of needles which have formed the fabric of the pocket. According to the invention, the transfer is carried out in two phases: in a first phase, the edge with the initial course of said fabric pocket is drawn toward said opposite area; and in a second phase, with the penetration of pin-shaped appendages into the fabric, said edge is moved further up to the needles of the arc complementary to that whose needles have formed the pocket; the needles of said complementary arc are raised and inserted into the fabric of the pocket, engaging it with the fabric which is to be formed by said needles.

The device according to the invention is applicable—for closing the initial end of a knitted article such as a sock or other—directly to a circular knitting or stocking machine which can form a portion of fabric in the form of a pocket with narrowing sections and widening sections along an arc of needles of approximately 180°, with a reciprocating motion of the cylinder or with a continuous motion and cutting of the threads. The device carries out the transfer of the initial partial edge formed by the arc of working needles for the pocket to the needles of the opposite arc, to which said edge is transferred. According to the invention, the device comprises, in combination,

- a push rod with a pick-up hook at the end, combined with a mechanism—adjacent to the internal wall of the needle cylinder—to move said push rod in an axial plane of symmetry to engage by means of the pick-up hook in an intermediate position the initial courses of the partial fabric released by the needles and to bring them progressively to the side opposite the arc of working needles during the progressive formation of the fabric of the pocket;
- a body in the form of a shaped annular ring, integral with the interior of the needle cylinder, and having a radial slot for the push rod and radial slots in the area opposite said arc of needles;
- in said latter radial slots, movable hooks with pin-shaped appendages which can be moved from a concealed position in the annular ring-shaped body to a raised position to make the pin-shaped appendages penetrate into the fabric along the initial partial fabric when this has been brought by said push rod to the side opposite the arc of working needles, and subsequently to move said initial fabric up to the needles which do not carry any yarn as yet these needles being raised and inserted into said initial fabric to engage the fabric with the yarn subsequently picked up by the needles for the formation of the fabric; and
- means for moving said hooks upward and centrifugally and then in the reverse direction.

Other characteristics are specified in dependent claims.

BRIEF DESCRIPTION OF THE INVENTION

The invention will be more clearly understood from an examination of the description and the attached drawing which shows a non-restrictive practical embodiment of the invention. In the drawing, FIGS. 1 and 2 show, in axial section and in a perspective view with parts removed, the needle cylinder with the device in a first configuration of the members of the device;

DETAILED DESCRIPTION OF THE PREFERRED EMBODIMENT

Figure 1:
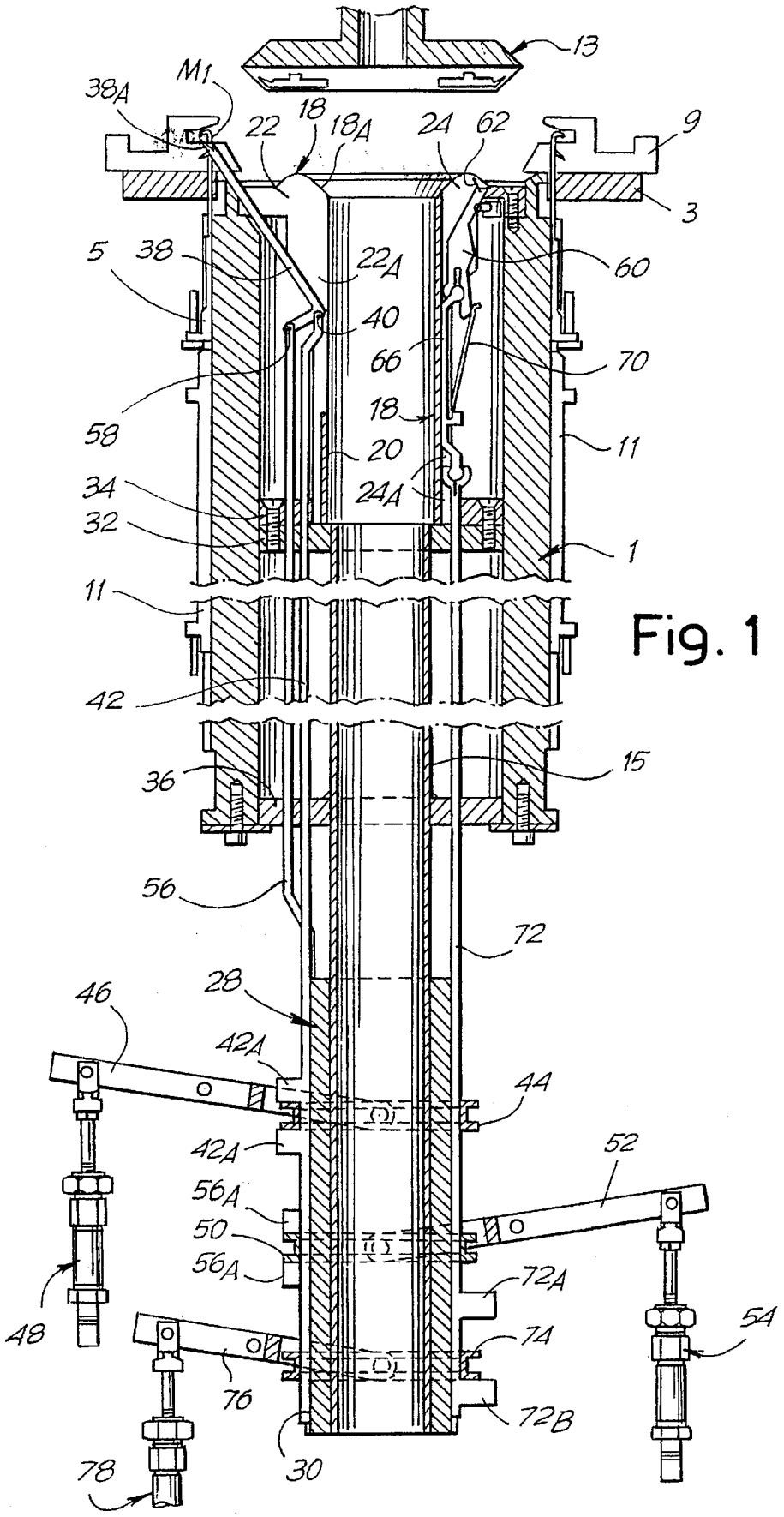

According to the drawing, the number 1 indicates the needle cylinder and 3 indicates the sinker ring; the needles are indicated by 5 and the sinkers by 9; the number 11 indicates pushers for the corresponding needles, housed in the longitudinal channels provided for the sliding of the needles. The number 13 indicates in a general and summary way the hook disk or dial, which may be provided for certain processes. The number 15 indicates a tube for tensioning and pneumatic removal of the article, which is arranged in a similar way to that in conventional machines to receive the article whose formation progresses within said tube and which is subsequently removed through it; in conventional machines, the upper part of the tube corresponding to tube 15 is flared in the form of a funnel for the entry of the article. In the solution shown in the drawing, this upper part of the tube 15 is replaced by an annular or tubular ring-shaped body 18 (see also FIG. 8 and equivalents) with a passage 20 corresponding to the duct 15 and with an upper flared profile 18A having the function of the flared, in other words funnel-shaped, profile of conventional ducts for conveying the article.

The body 18, which is substantially shaped in the form of an annular ring, has an upper flange-shaped part supported on an annular step formed at the upper end of the needle cylinder 1. The body 18 has a longitudinal channel which expands upwardly into the area of the shaping 18A as a radial slot 22 for the purposes indicated below; the channel and slot 22 is developed from the outer surface of the body 18, but in the upper part is also extended at 22A as far as the central passage 20. On the side opposite the channel and slot 22, and symmetrically with respect to the plane of said slot 22, the body 18 has over an arc of approximately 180° opposite the arc A (see FIG. 8) a fan of radial slots 24 in the upper part, which are extended as external channels 24A. In the portions of the external upper ring of the body 18, between the adjacent slots 24, there are formed (see also FIGS. 8 to 11) housings for control buttons 26 which can be moved angularly and fixed in the desired position in such a way that they form with an appendage 26A of each of said buttons 26 an adjustable supporting stop for the purposes described below.

Figure 8:
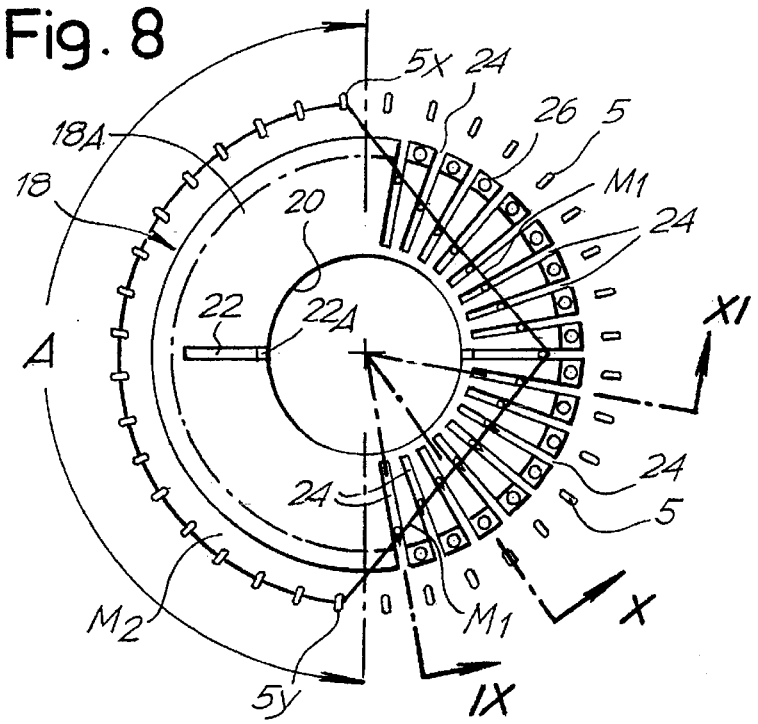
FIG. 8 is a schematic and partial plan view taken through VIII—VIII in FIG. 7.

FIG. 8 shows the arc A in which the slots 24 are not provided, said arc A extending over approximately 180°, while the fan of slots 24 is located over the opposite arc which is of approximately equal extent.

Figure 20:
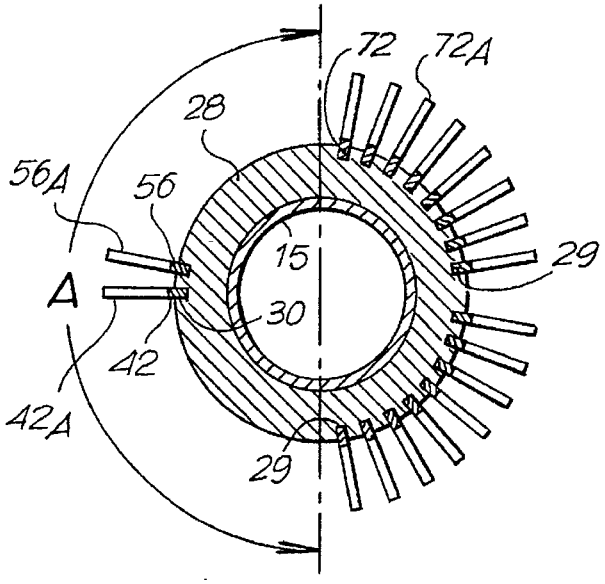

The duct 15 coaxial with the needle cylinder is extended below the needle cylinder and supports a cylinder 28 provided (see also FIG. 20) with longitudinal channels 29 corresponding to the channels 24, and on the opposite side a channel 30 corresponding to the channel 22 and a further channel at the side of and adjacent to the channel 30.

The duct 15 and the body 18 are engaged with the through cavity of the cylinder 1 by means of flanges 32, 34 and 36. In these flanges there are passages corresponding to the slots 22 and 30, to the slot adjacent to the slot 30, and to the slots 24 and 29, for the passage of operating members to be described.

A push rod 38 which can be moved in the geometrical plane of symmetry delimited by the slot 22 and by the fan of slots 24 is housed movably in the slot 22, 22A. The push rod 38 has a pick-up hook 38A, for the purposes stated below, at its upper end. The push rod 38 is hinged at 40 to the end of a rod 42 which is approximately parallel to the axis of the needle cylinder and to that of the duct 15, said rod 42 being slidable in the passages formed in the flanges 32, 34, 36 and in the channel 30 of the cylinder 28 and in the channel 22A. The rod 42 has at its lower end a pair of stubs 42A which are engaged with a ring 44 which surrounds the cylinder 28 and can be made to slide along said cylinder 28 by a fork 46 which is movable by means of a suitable actuator 48. It is therefore possible, by means of the actuator 48 and the ring 44, to maneuver axially the rod 42 and therefore the hinge 40 and consequently the push rod 38. The number 50 indicates a second ring which may be moved by means of a fork 52 by an actuator 54; the ring 50 can therefore also be moved along the cylinder 28 like the ring 44, and independently of the ring 44, but in synchronization with certain movements of the latter, for the purposes indicated below. The ring 50 is held between two stubs 56A of a second rod 56 movable parallel to the rod 42 and hinged in its upper part at 58 to a bracket appendage of the push rod 38, to cause angular movements of the push rod 38 about the hinge 40 by the effect of relative movements between the rod 42 and the rod 56. The two actuators 48 and 54, with suitably combined commands, can therefore cause movements of the push rod 38 in said axial plane defined by the slot 22, in such a way that the pick-up hook end 38A of the push rod 38 can be made to move along a trajectory which is virtually rectilinear and diametral, and which is located within the working and stitch formation area of the needles 5, as may be seen in the various figures showing the axial sections relating to the various configurations which may be adopted by the members of the device, and therefore in particular by the push rod 38. The function of said push rod 38 will be described subsequently.

Figure 9:
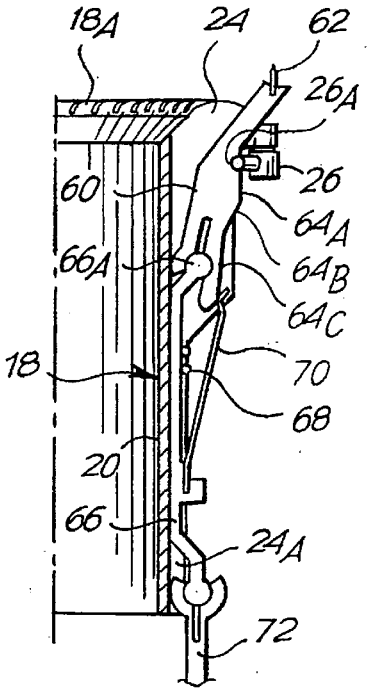
FIGS. 9, 10 and 11 are half-sections through IX—IX, X—X and XI—XI in FIG; 8.
Figure 10:
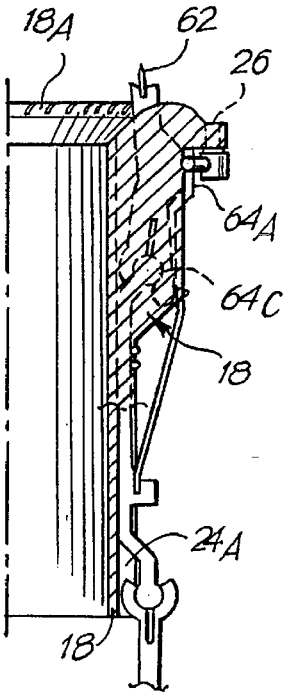
Figure 11:
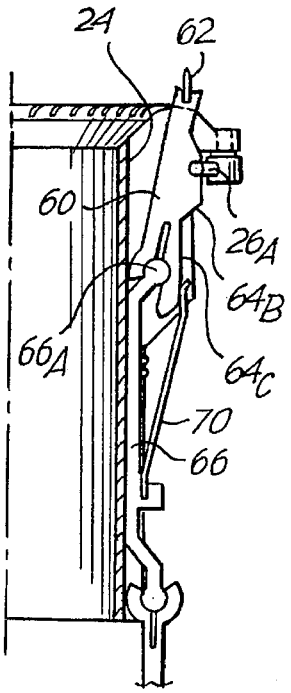
Figure 15:
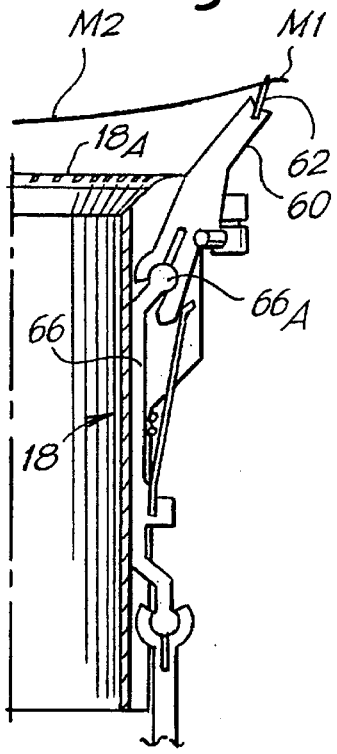
Figure 16:
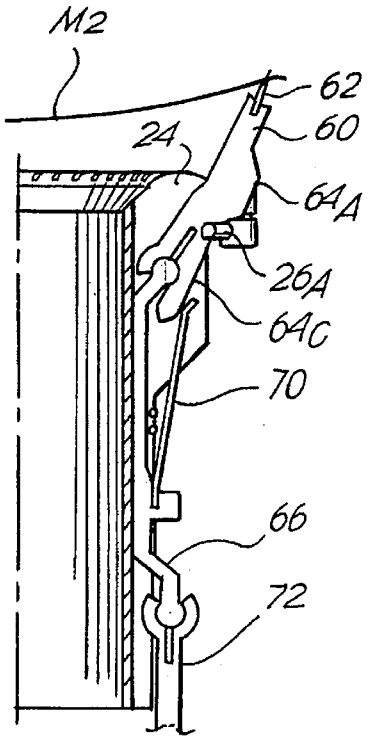
Figure 17:
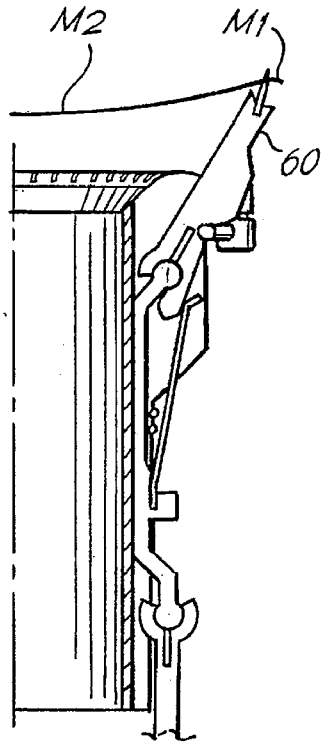
Figure 21:
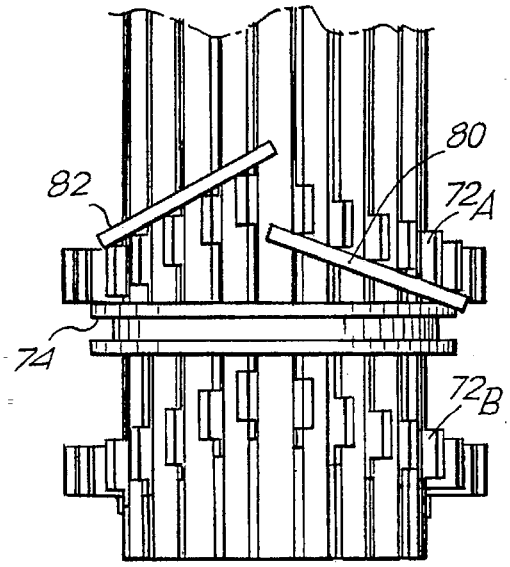
Figure 22:
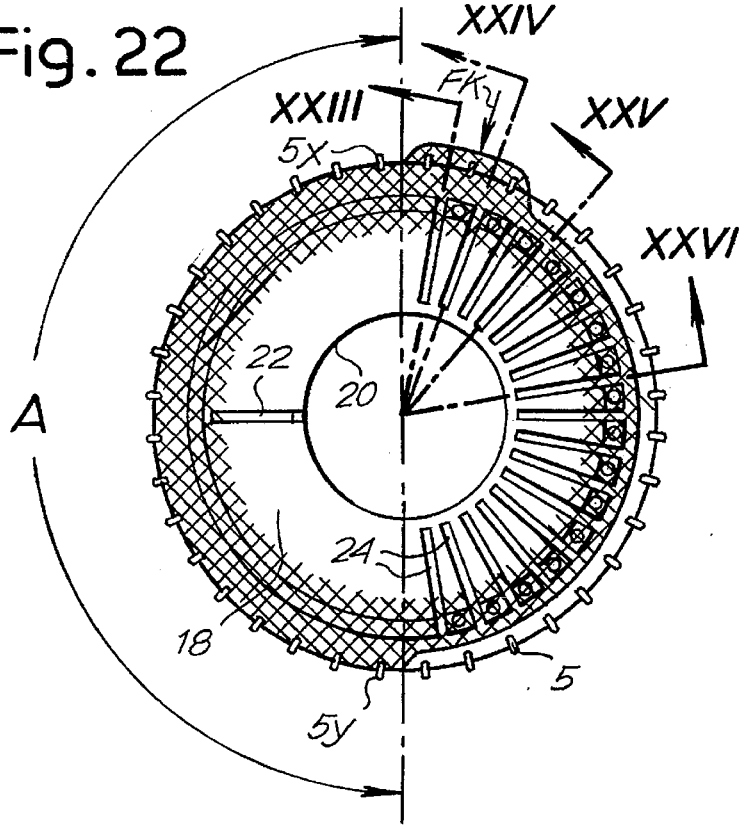
FIG. 22 is a schematic plan view taken through XXII—XXII in FIG. 19.

A movable hook 60, provided with an upward-pointing pin-shaped appendage 62, is housed in each of the slots of the fan 24. The hooks 60 differ in profile from each other or at least are in groups with different profiles in the various slots 24, with a symmetrical distribution with respect to the plane defined by the slot 22; the shapes of the hooks 60 are easily determined from a comparison, in particular, of FIGS. 9, 10, 11 with FIGS. 15, 16, 17 which indicate some of these hooks 60 identified by the same reference number but differing from each other in shape. Regardless of its shape, each of the hooks 60 has a discontinuous external profile 64A, 64B, 64C to interact with the appendage 26A of the corresponding adjusting peg 26, which is located in front of the slot 24 containing the corresponding hook 60. Each of the hooks 60 also forms a hinge socket for an end 66A of a slider 66, which is retained by suitable springs 68 within the channels forming the downward extension of the slots 24. A flat spring 70 acts between each slider 66 and the profile 64C of the corresponding hook 60, and bears on the lower end of the corresponding hook 60 below the hinge 66A, thus stressing the corresponding hook 60 in a clockwise direction as seen in. FIGS. 9 to 11 and other corresponding figures; the Stress imparted by the spring 70 causes the corresponding hook to bear elastically With its external profile 64A, 64B, 64C on the appendage 26A of the corresponding adjusting peg 26. The purposes of this disposition will be described subsequently. At the lower end, each slider 66 is linked to a rod 72 which extends downward into the corresponding channel of the cylinder 28; each rod 72 has a pair of stubs consisting of an upper stub 72A and a lower stub 72B, suitably separated from each other. An axially slidable ring 74 passes between the two stubs 72A and 72B of each rod 72, and can be moved through a fork 76 by an actuator 78 similar to the actuators 48 and 54. Additionally, two cams 80 and 82, carried by a structure fixed with respect to the machine, are provided outside the cylinder 28, in the area of the stubs 72A (see in particular FIG. 21), and can be brought up to the cylinder 28 at the correct time to act on the stubs 72A. When the needle cylinder, and therefore also the cylinder 28, rotate, said cams 80 and 82 cause the raising and subsequent lowering of the stubs 72A and therefore of the rods 72 and of the sliders 66. This causes a corresponding movement in the hinge 66A and therefore a vertical component of movement of the hooks 60. Since the hooks 60 are hinged to the corresponding ends 66A, the movement of the hooks 60 is a combination of said vertical movement and an angular movement which is caused in each of the hooks 60 by the fact that each spring 70 causes the corresponding hook 60 to bear elastically with the profiles 64A, 64B and 64C on the adjustable support formed by the corresponding appendage 26A. The positions which the hooks can assume may be seen in the various figures of the drawing and will be described subsequently. The cams 80 and 82 are movable so that they may be brought into the active and inactive positions with respect to the stubs 72A. In the active position of said cams, the needles will be raised until they penetrate into the fabric, as described below and for the purposes indicated. By a movement of the ring 74 it is possible to cause a simultaneous and equal raising of all the hinges 66A of the hooks 60 by the action of said ring 74 on the stubs 72A. By the action of the cams 80 and 82 at the correct time, it is possible to cause, selectively and progressively, the maximum raising and then the lowering of each of the rods 72 and therefore of each of the hinges 66A and a corresponding movement of the corresponding hooks 60 in succession, independently of the position of the ring 74; the movements caused by the cams 80 and 82 are allowed by the distance between the stubs 72A and 72B. A simultaneous lowering of all the rods 72 and therefore of the hinges 66A is obtained with the lowering of the ring 74 and the consequent action of this ring on all the stubs 72B.

The operation of the device in combination with the cylinder 1 of the needles 5 of the circular knitting machine is as follows.

Figure 2:
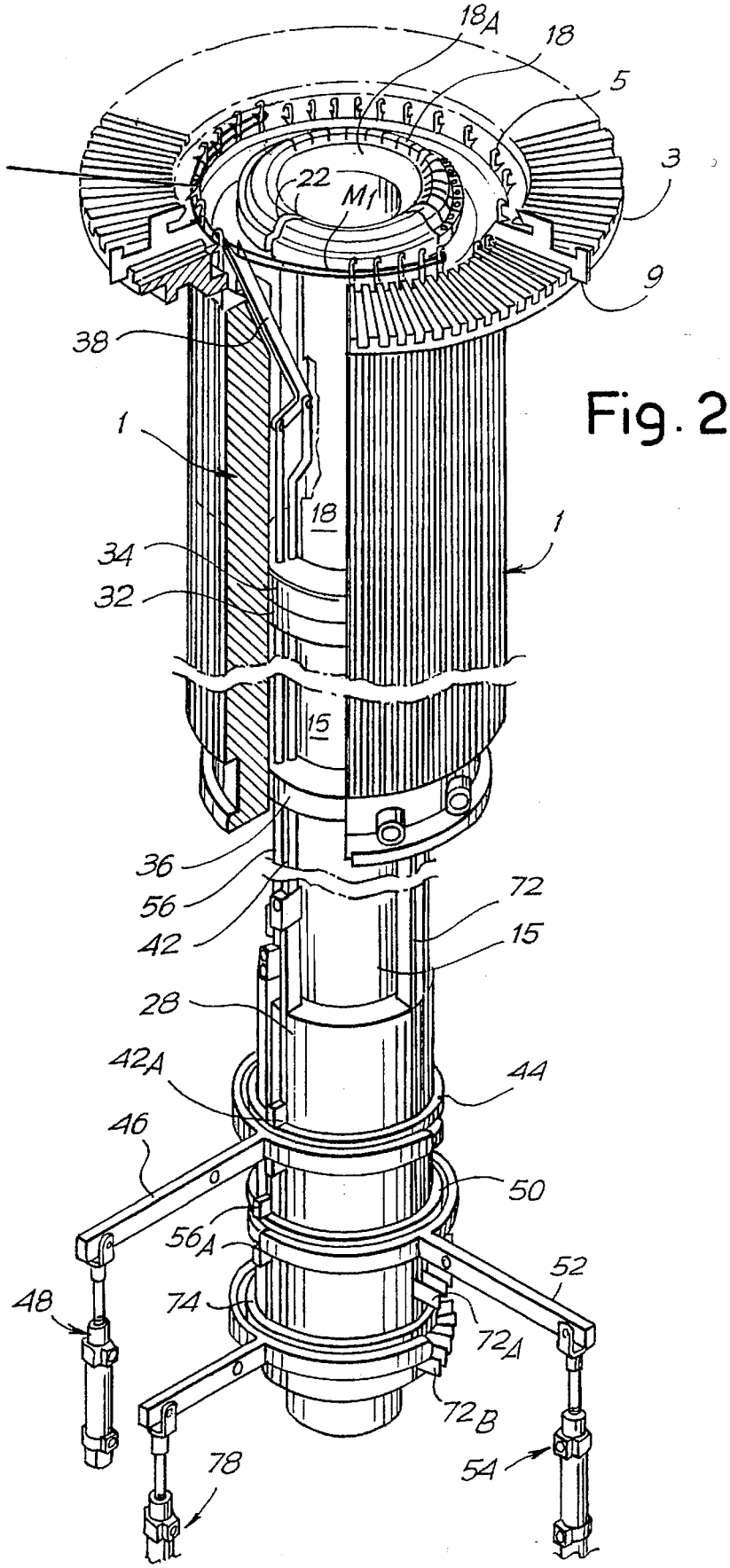
Figure 3:
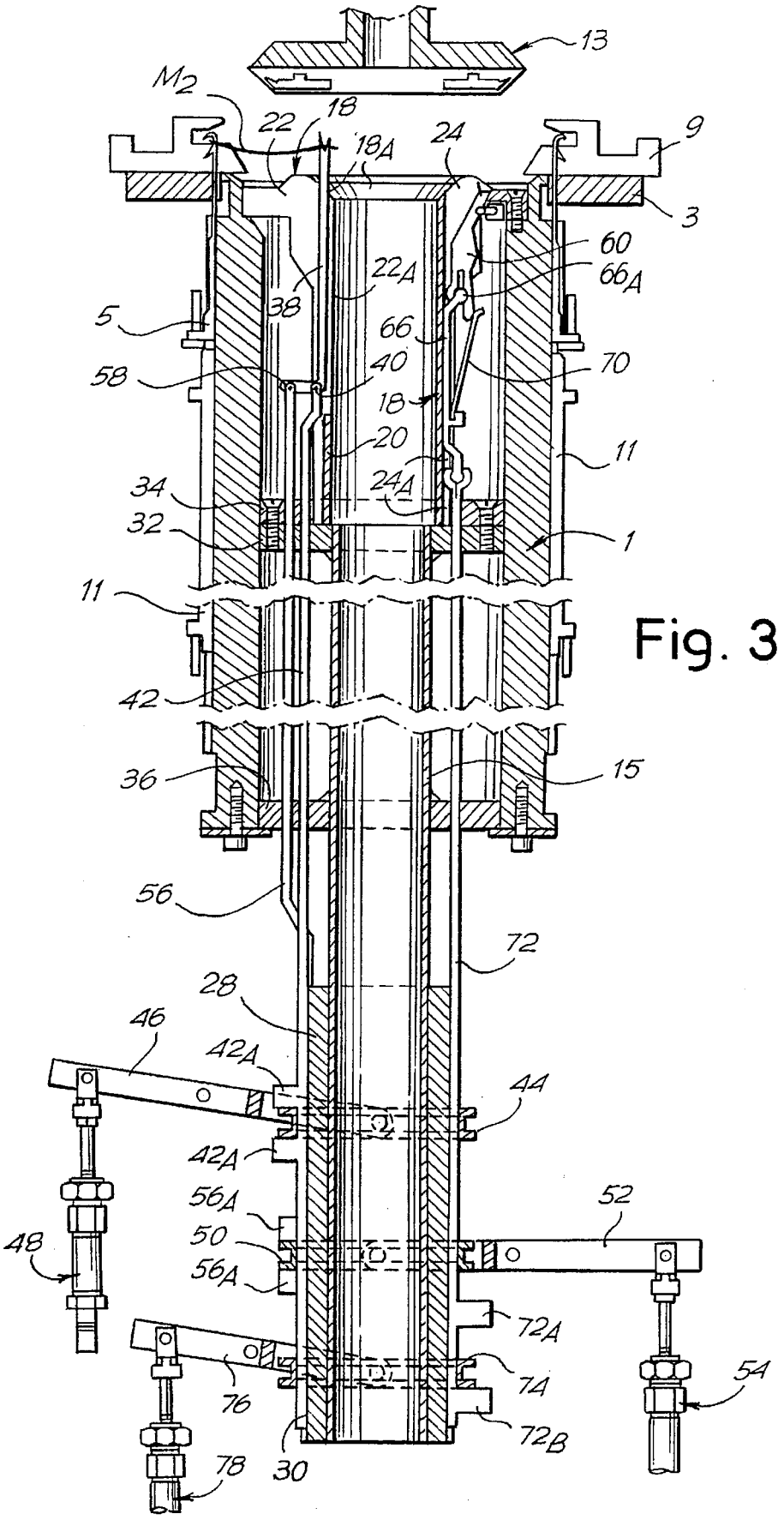
FIGS. 3 and 4 show, in a similar way to FIGS. 1 and 2, a second subsequent configuration, FIG. 4 being partial and enlarged.
Figure 4:
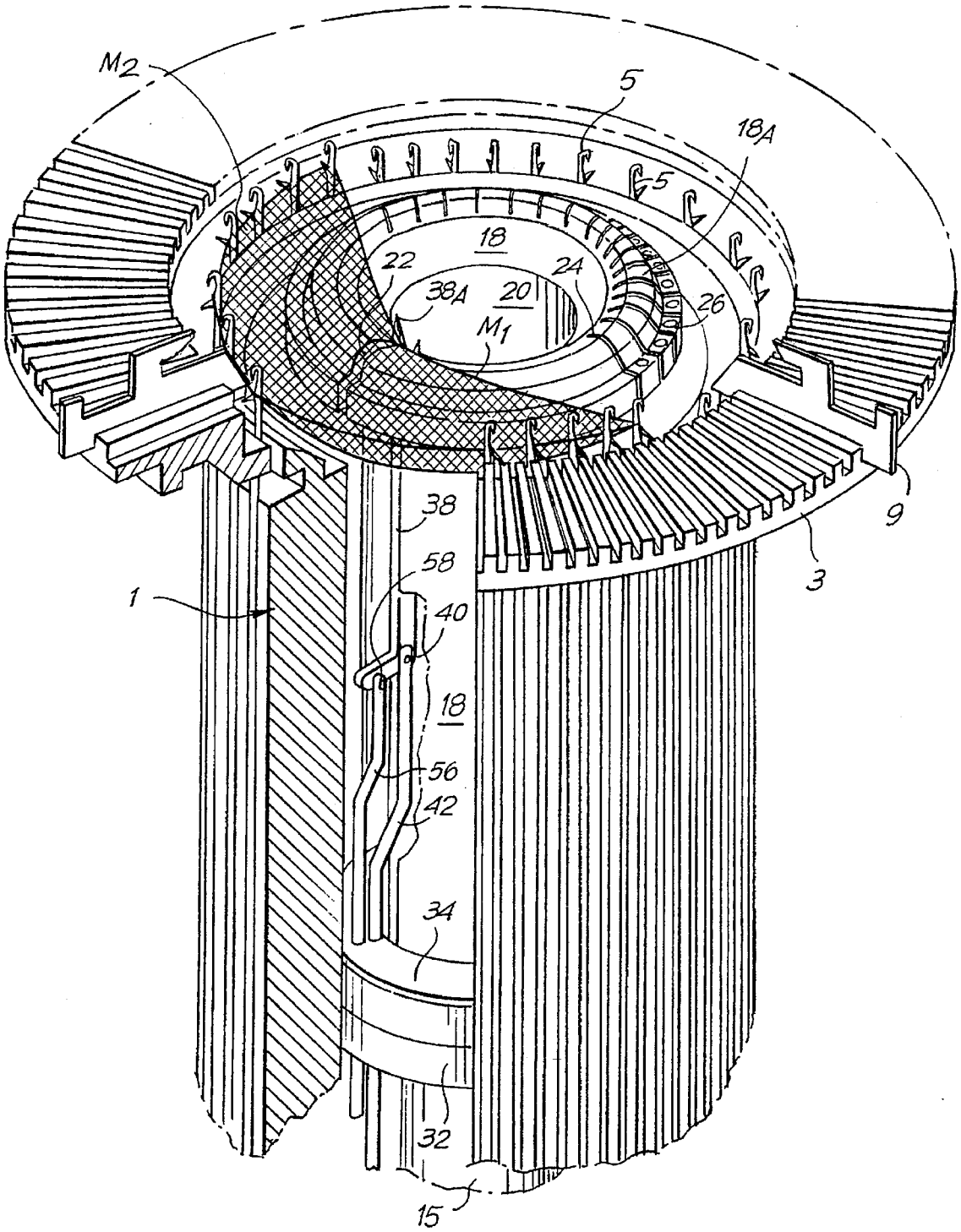
Figure 5:
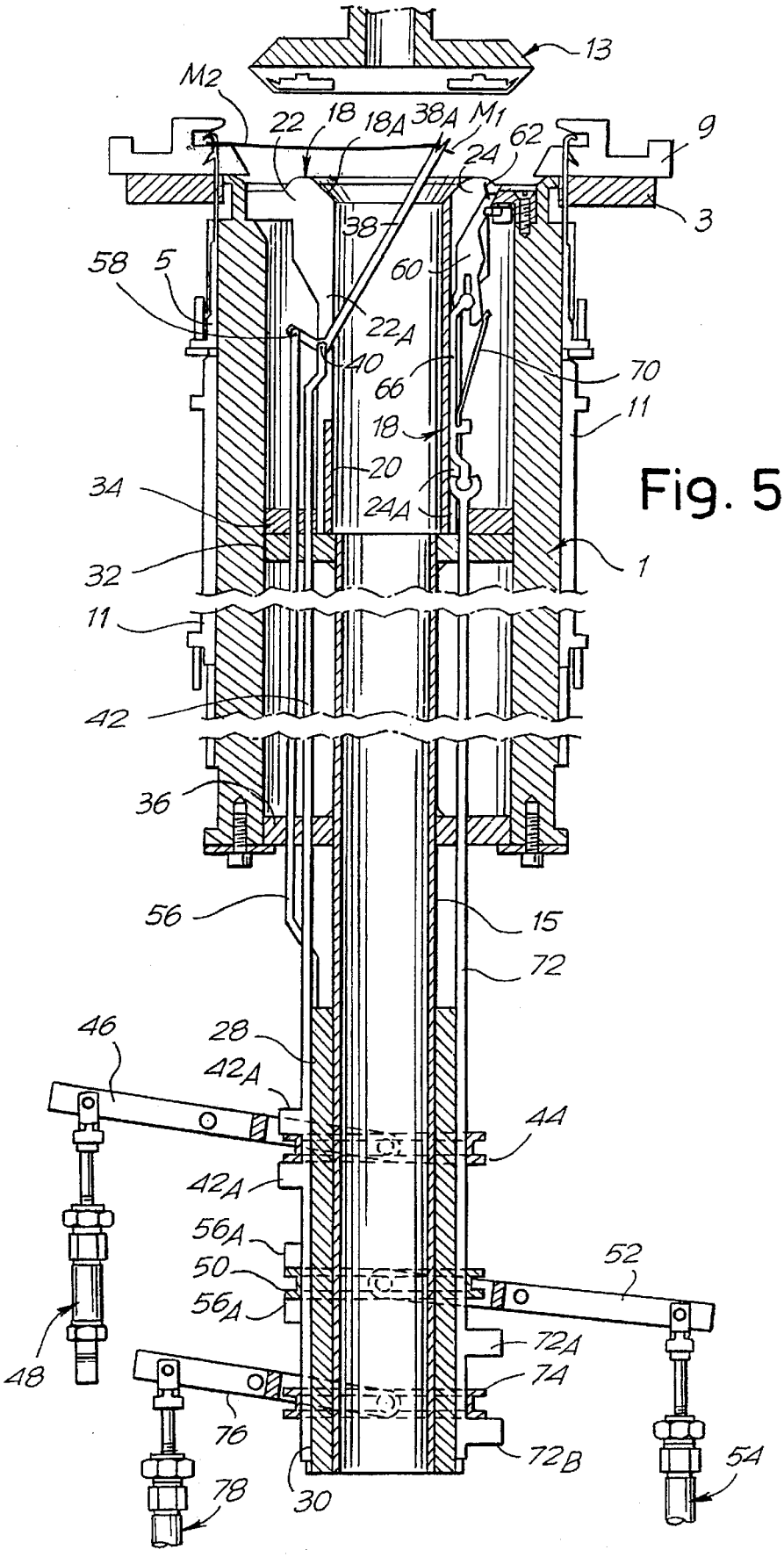
FIGS. 5, 6 and 7 show, in a similar way to FIG. 1, three further subsequent configurations.
Figure 6:
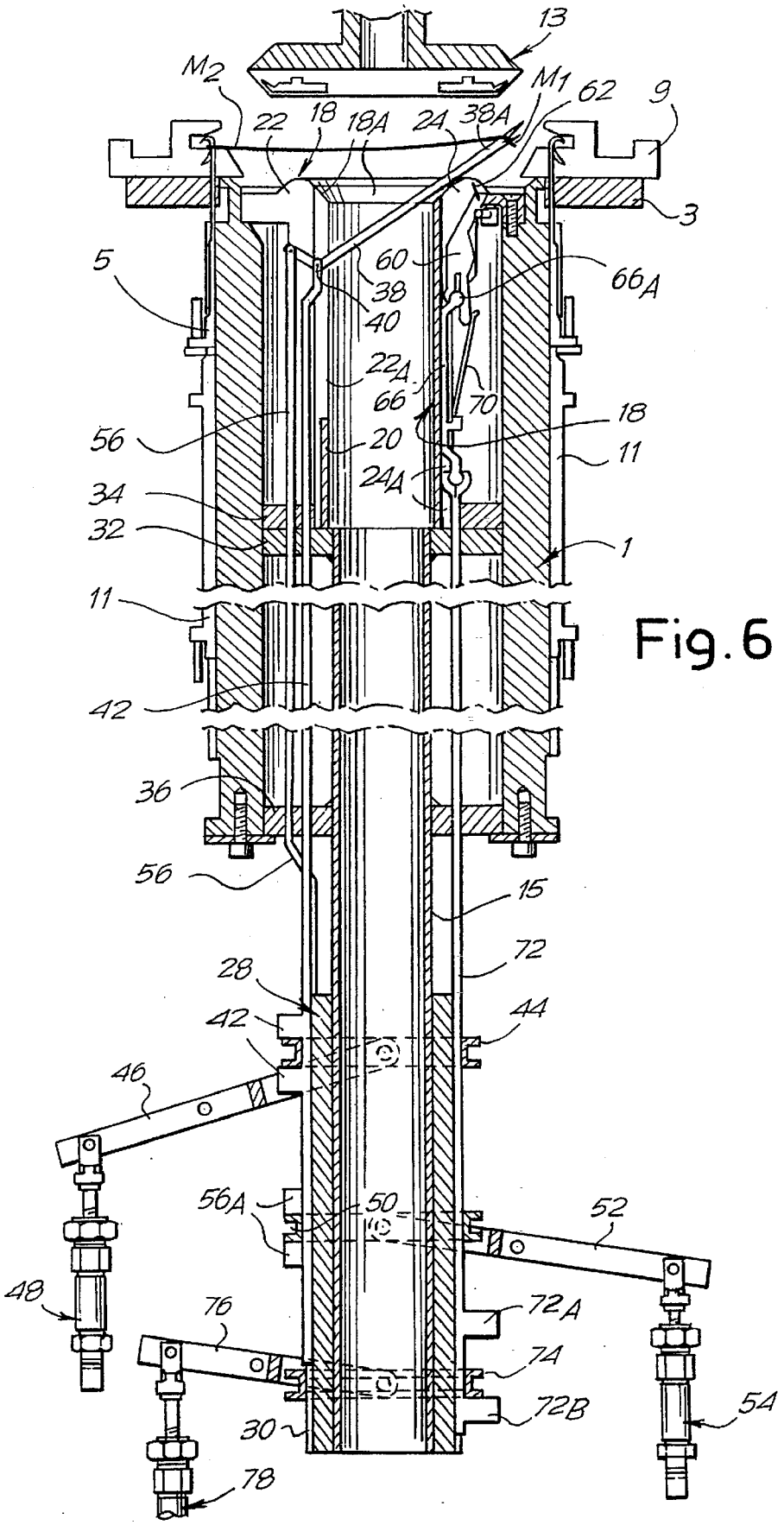
Figure 7:
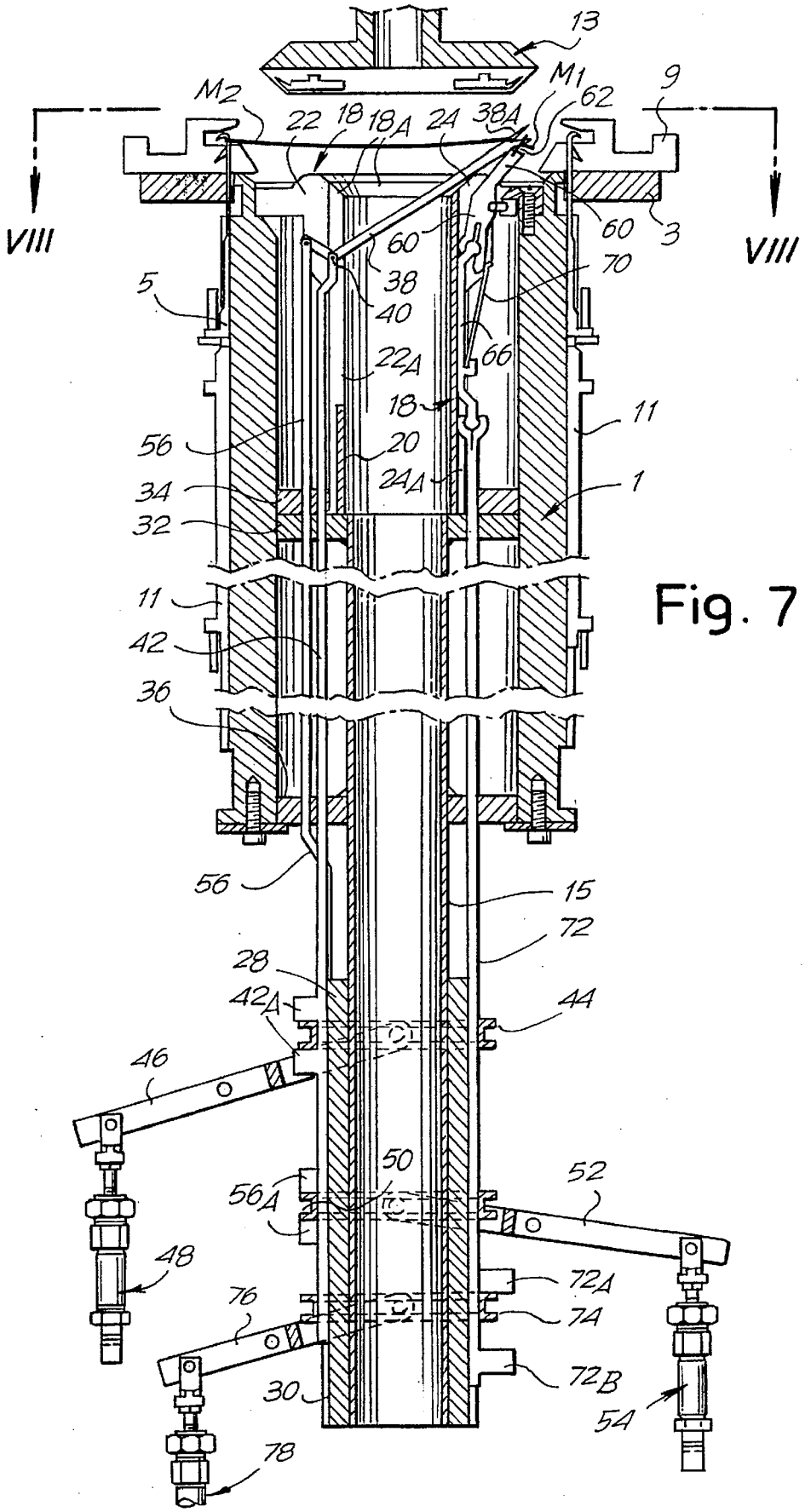
Figure 12:
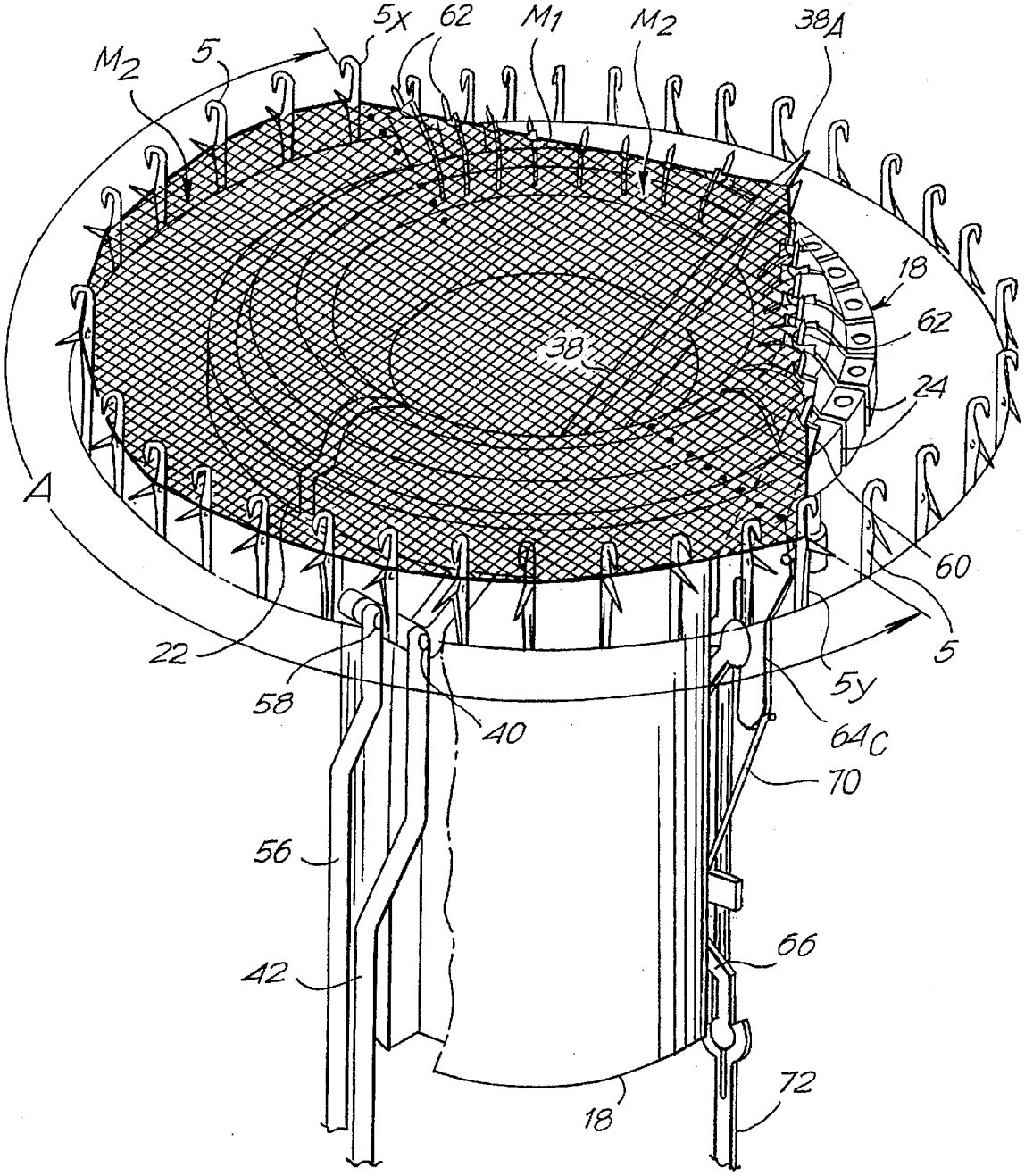
FIG. 12 is an enlarged perspective view of the upper part of FIG. 7.
Figure 13:
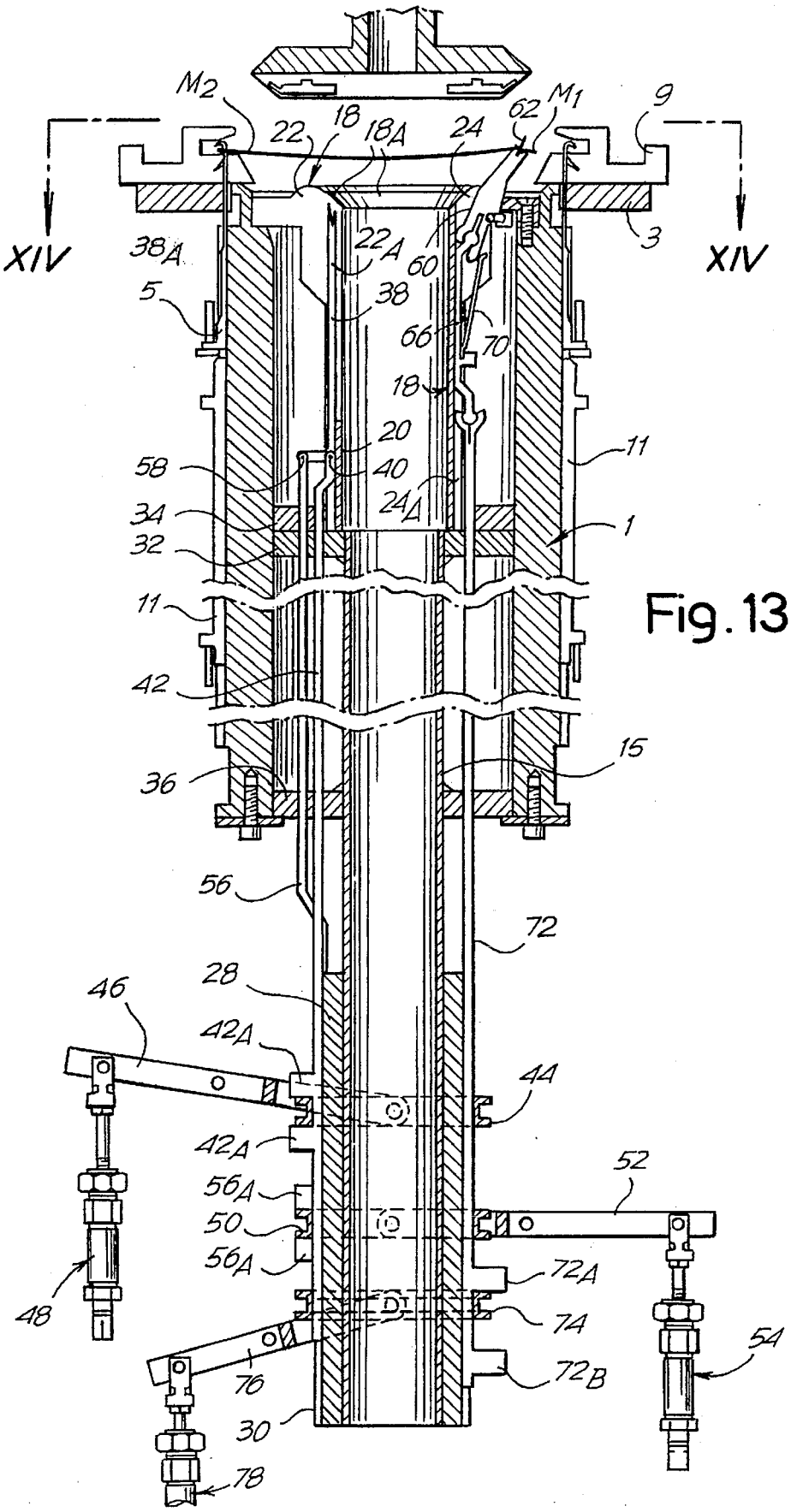
FIGS. 13, 14, 15, 16 and 17 show a further configuration in section similar to that in FIG. 7, in a schematic plan view taken through XIV—XIV in FIG. 1, and in partial half-section through XV—XV, XVI—XVI and XVII—XVII in FIG. 14.
Figure 14:
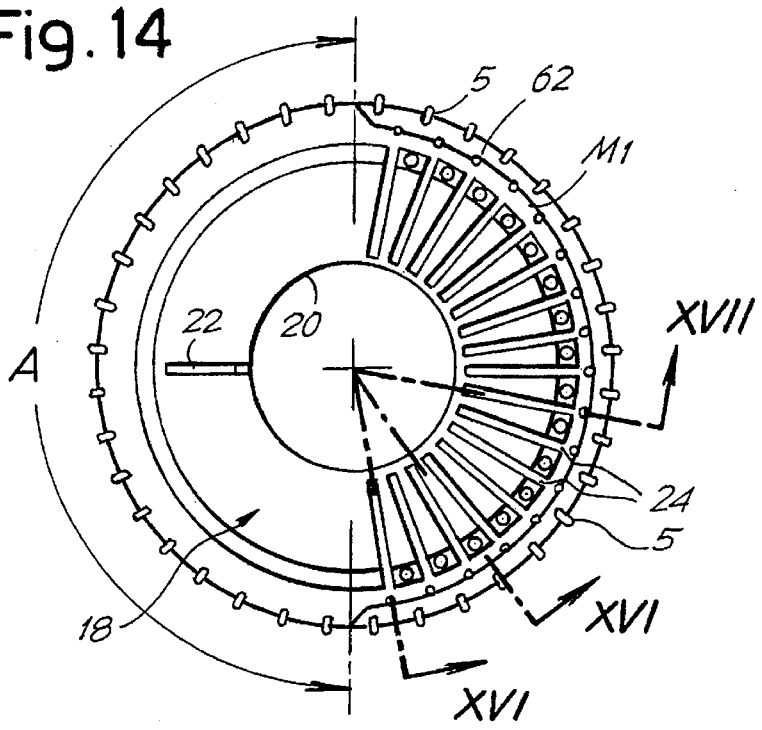
Figure 18:
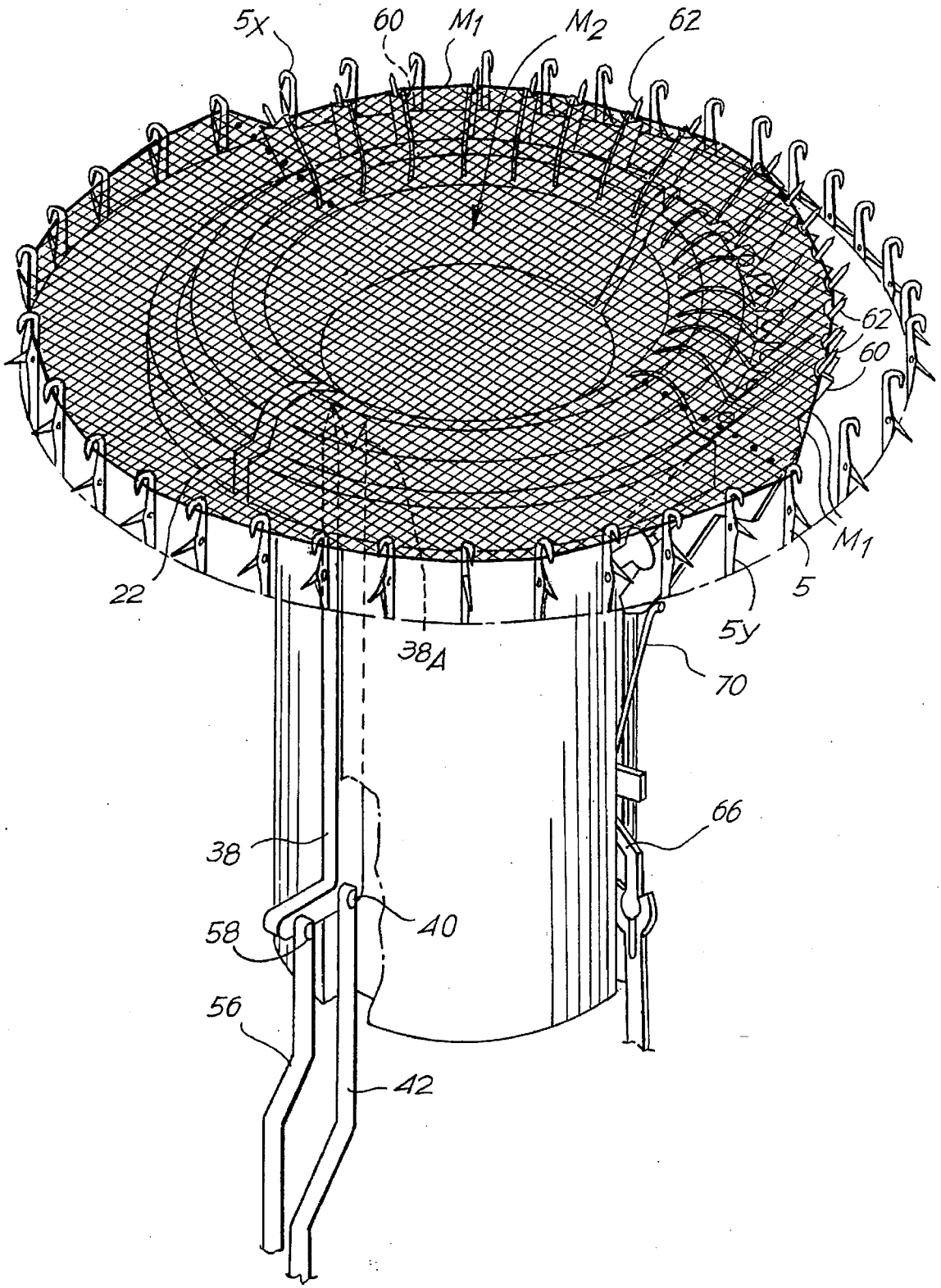
FIG. 18 is a perspective view of the upper part of FIG. 13.
Figure 19:
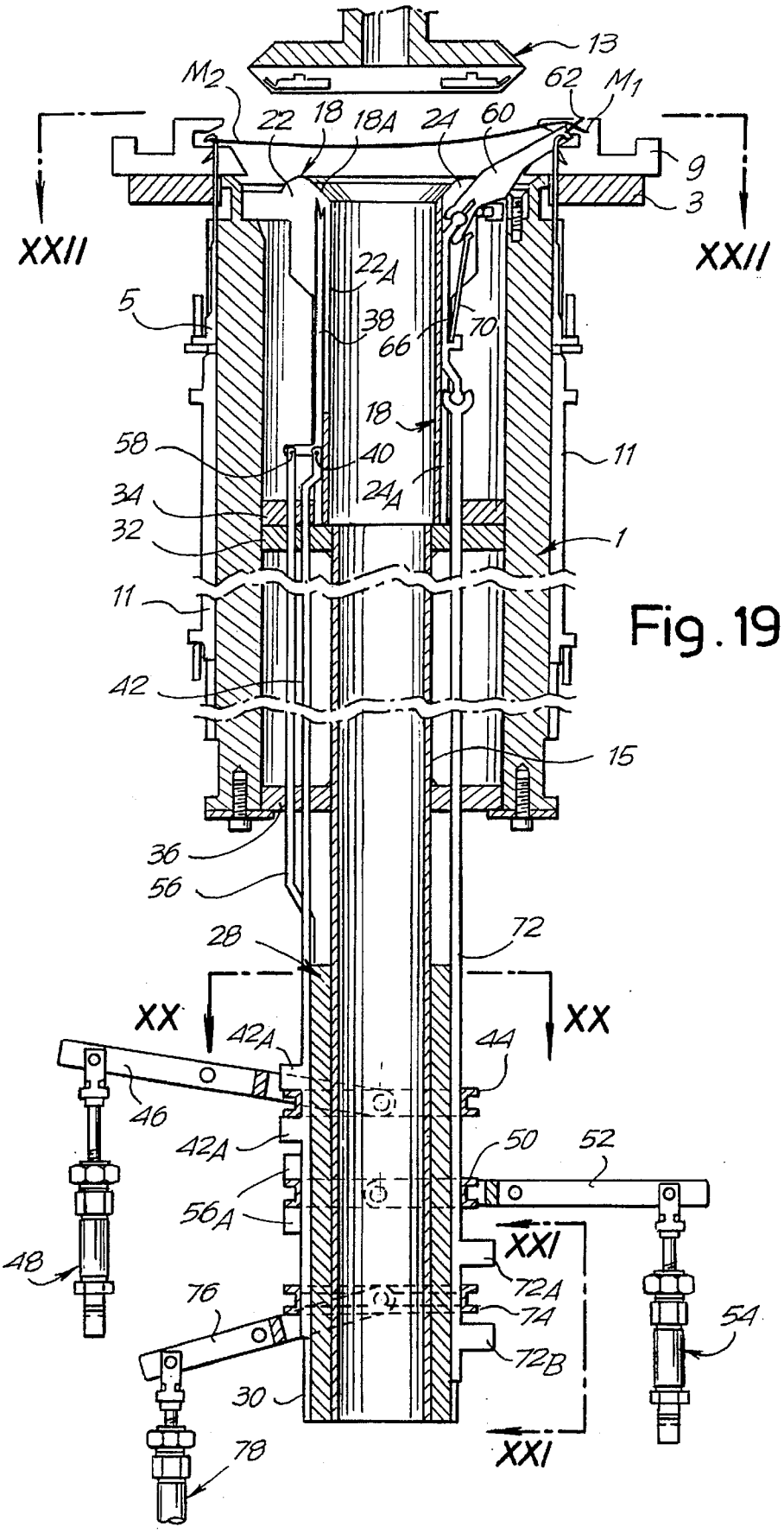
FIGS. 19, 20 and 21 show a further configuration in a view similar to that of FIG. 1, a section through XX—XX and a view taken through XXI—XXI of FIG. 19.
Figure 23:
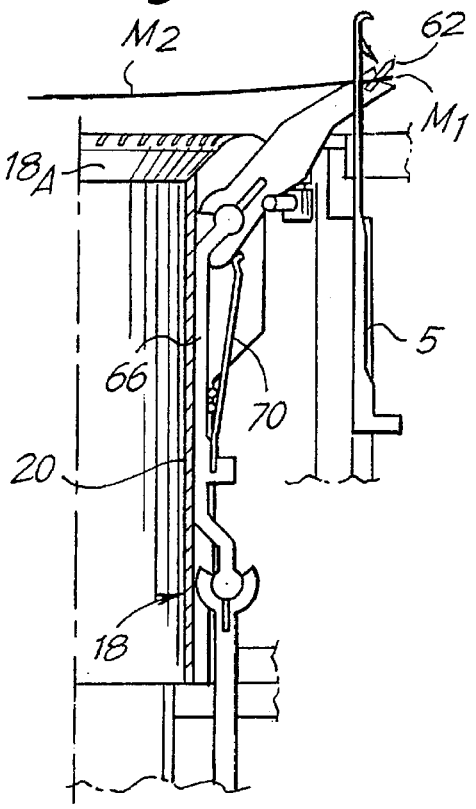
FIGS. 23, 24, 25 and 26 are half-sections through XXIII—XXIII, XXIV—XXIV, XXV—XXV and XXVI—XXVI in FIG. 22.
Figure 24:
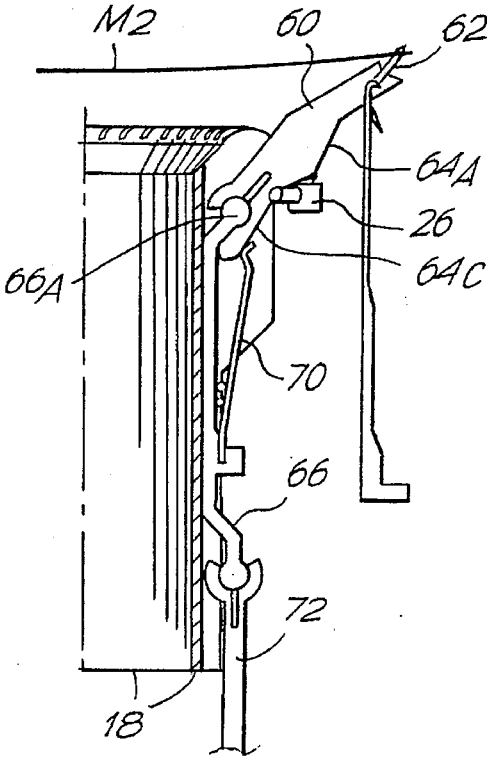
Figure 25:
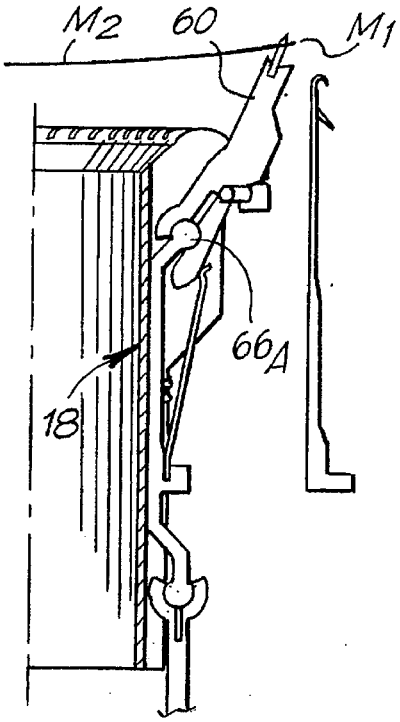
Figure 26:
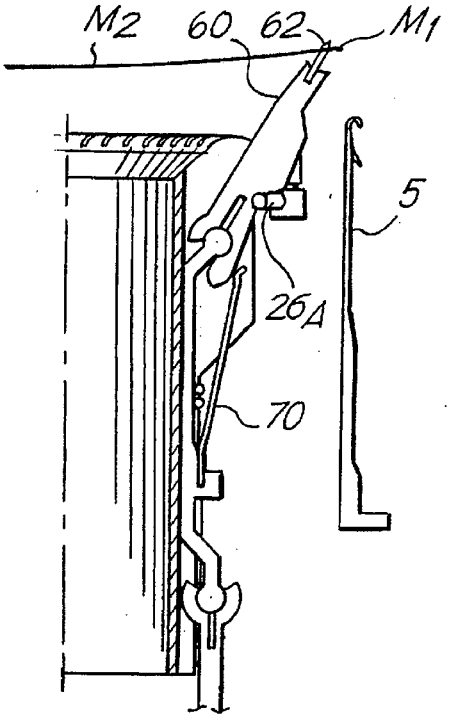
Figure 27:
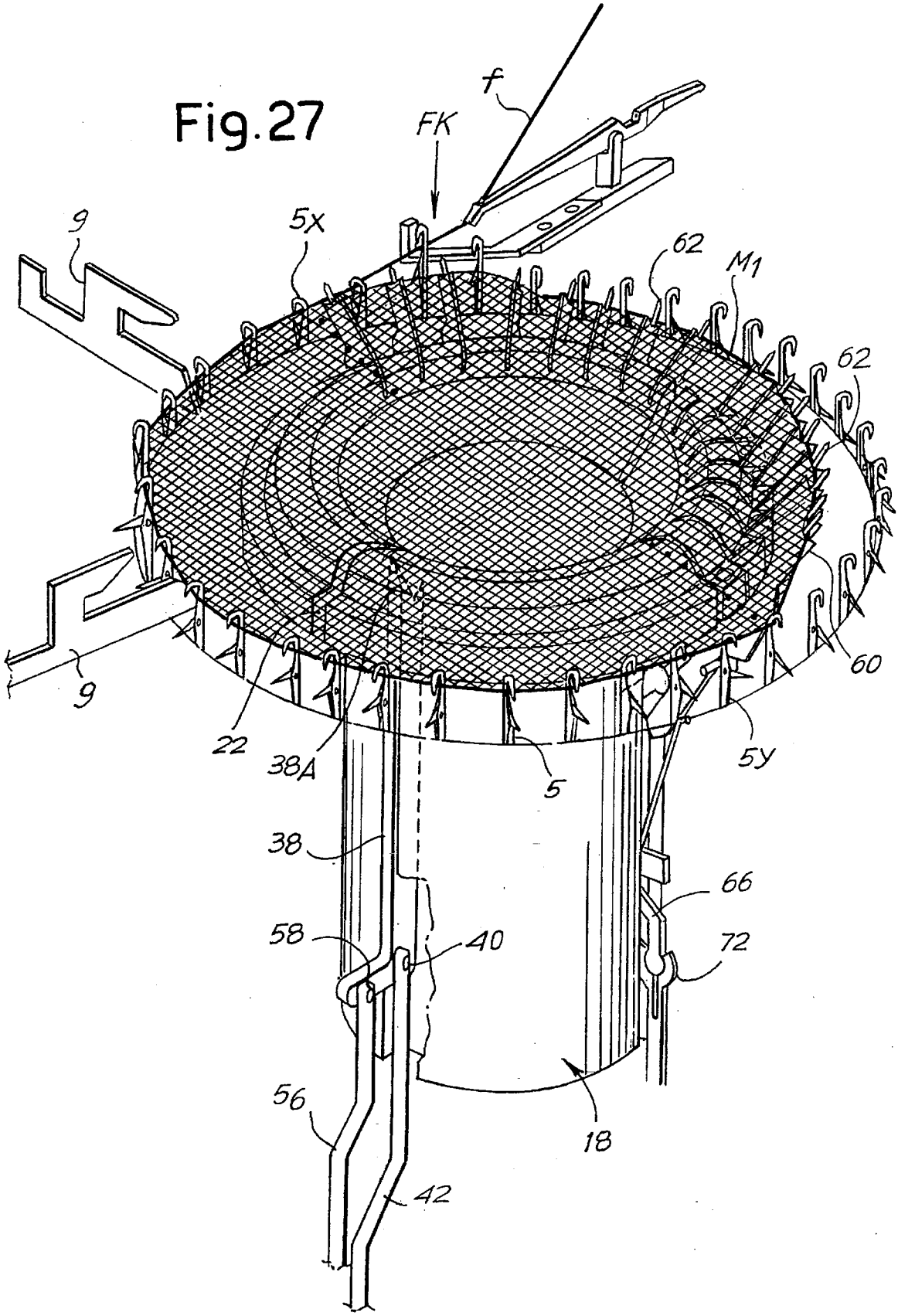
FIG. 27 is an enlarged perspective view of the upper part of FIG. 19.

It is assumed that the circular knitting machine is of the type suitable for the, formation, by reciprocating motion, of a pocket of fabric, with widening sections and narrowing sections of stitches in successive courses, by means of the needles of the arc of needles A (FIGS. 8, 10, 20, 22) on the side of the slot 22, while the needles of the complementary arc containing the slots 24 and the hooks 60 are inactive. At the start of formation of the fabric of a pocket, the first courses M1 (FIGS. 1 and 2) are formed along the arc of needles indicated by A which are active, by means of the reciprocating motion of the needle cylinder (or the continuous motion of the cylinder with cutting of the yarn). As soon as the initial formation of the fabric with the initial courses M1 of the pocket has commenced, or during this formation, the push rod 38 is raised with the rod 42 and by means of the ring 44 by the actuator 48, and the rod 56 is simultaneously raised by means of the ring 50 and the actuator 54; the relative movement between the two rods 42 and 56 is such that the push rod 38 is raised from the position shown in FIG. 28 in which it is withdrawn into the body 18, and is inclined into the configuration shown in FIGS. 1 and 2, as a result of which the pick-up hook 38A of said push rod 38 engages, in an intermediate position, said edge M1 immediately after the start of its formation. In these initial conditions, and during the formation of the fabric M2 of the pocket, the hooks 60 are all withdrawn, as clearly indicated in FIGS. 1 to 6 and 28. As the fabric M2 of the pocket is formed, and increases progressively as shown in FIGS. 3 and 4 and then in FIG. 5, the edge M1 of said fabric M2 is made to advance progressively by the pick-up hook 38A of the push rod 38, and is inclined progressively toward the right as seen in the figures, until it passes, along a virtually transverse and diametral trajectory, through the central area of the needle cylinder and above it, imparting a virtually triangular configuration to the edge M1 as shown in FIGS. 6 and 7 and in particular in FIGS. 8 and 12. At the end of the movement of the push rod 38 from the initial configuration to the inclined configuration and then to the position shown in FIGS. 7 and 8, the push rod 38 with the hook 38A has stretched the edge M1 between the end needles 5X and 5Y (FIGS. 12 and 18) of the arc A of working needles and with the vertex at the position reached by the pick-up hook 38A and the central point of the edge M1. In this configuration (see in particular FIGS. 8 and 12), the edge M1 is above the slots 24 which house the hooks 60, all withdrawn into the slots 24. At this point, by a rising movement of the ring 74, all the hooks 60 (by the action of said ring on the stubs 72A) are simultaneously raised and therefore reach the position shown in FIGS. 9 to 12, in which the pin-shaped appendages 62 of the various hooks 60 have "pierced" the fabric M2, or in other words have penetrated into the fabric M2 immediately adjacent to the edge M1; the difference in profile of the hooks 60 of the various slots 24 is designed to make the pin-shaped appendages 62 of each of the hooks 60 engage with the fabric M2 along the edge M1. For precise adjustment of the positions of the individual pin-shaped appendages 62, use is made of the adjustment buttons 26 of the corresponding appendages 27A, which define the exact positions of the edge section 64A of the individual hooks 60 for the purpose stated above, against the elastic action of the spring 70 which in each case tends to press the edges 64A, 64B, 64C of the hooks 60 against the adjustable supports 26A. After the raising of the hooks 60 and the engagement of the pin-shaped appendages 62 with the fabric M2 along the edge M1 with the triangular configuration, the push rod 38 is lowered again to the position shown in FIG. 13, by the action of the combined downward movement of the rods 42 and 56 by means of the rings 44 and 50. The various types of hooks 60 assume the position shown in FIGS. 15, 16 and 17, having engaged with the edge M1 of the fabric M2. With the further simultaneous raising of the sliders 66 by means of the ring 74, the hooks 60 are moved from the configuration shown in FIGS. 13, 15, 16 and 17 to a further, more inclined configuration which is virtually radial, as shown in FIG. 18, in which the edge M1 of the fabric M2 of the newly completed pocket is brought firmly up to the needles 5. When this position has been reached by the raising of the ring 74, the rotation of the needle cylinder and the insertion of the cams 80 and 82 causes a further temporary raising of each of the rods 72 beyond the position illustrated in FIG. 13 and in FIGS. 15 to 17, so that each of the hooks 60 is successively and progressively pushed in the centrifugal direction with its pick-up hook end by the action of the raising caused by the cam 80, until the fabric M2 is brought into the area of the edge M1 above the needle which corresponds to the working area of the cams 80 and 82, as seen in the area indicated by the arrow fk in FIG. 27. The needles are raised to the maximum in this area fk, and each of them progressively penetrates the fabric in the vicinity of the edge M1 which is firmly moved above the needle area so that it can be perforated by the needles as shown in FIG. 23. In this way, each needle, having perforated the fabric M2 immediately inside the edge M1 and being lowered, forms a stitch with the yarn f (see FIG. 27) suitably fed, thus engaging the edge M1, at the start of working of the tubular fabric with all the needles, and thus closing the pocket by engaging the edge M1 with the needles of the arc opposite the arc A and consequently with the needles corresponding to the area of the fan of hooks 60 and slots 24. The progressive raising and lowering of the individual needles of said arc which now come into operation causes the progressive linking and the formation of the first course of stitches of the tubular article which thus has its toe closed with the edge M1 of the pocket of fabric M2 engaged with the initial course of the tubular fabric. As soon as they have transferred the edge M1 of the pocket M2 to the needles which are coming into operation,.the hooks 60 are returned downward by the ring 74, while the action of the cams 80 and 82 has ceased as they are moved out of the operating position. The tubular fabric of the stocking or sock is then formed, and extends along and within the space defined by the cylindrical walls of the members 20, 15, 28.

Figure 28:
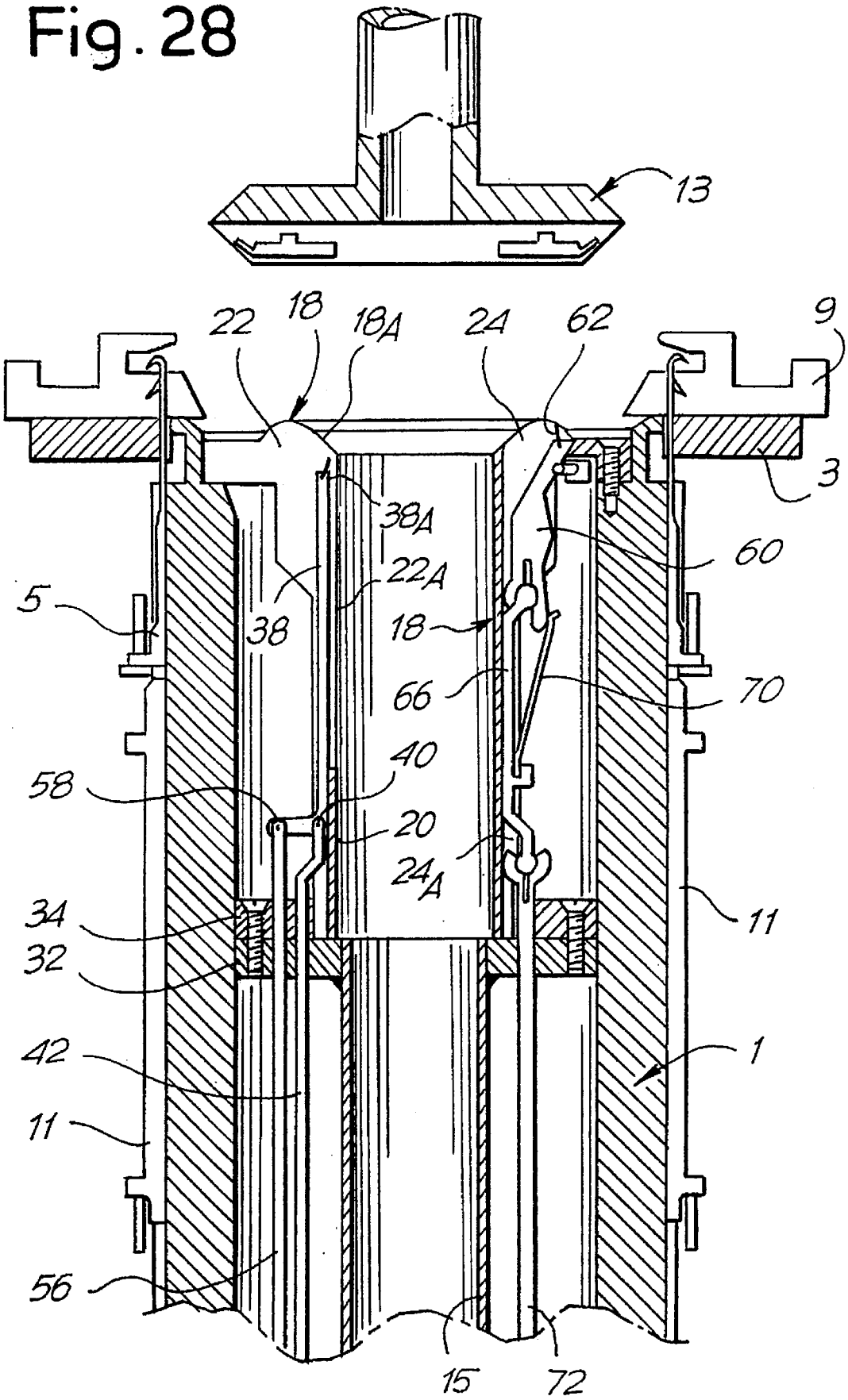
FIG. 28 shows a further, resting configuration of the device in a similar way to FIG. 1.

The device described may be applied easily to the cylinders of existing stocking or sock machines with simple adaptation, while satisfactorily retaining the function previously performed by the tube similar to tube 15 with an upper funnel-shaped flaring, the flaring being provided, in the device described here, by the upper profile 18*a* of the annular body 18, with the hooks 60 completely withdrawn into the slots 24 and with the push rod 38 also withdrawn, as shown in FIG. 28, into the slot 22.

It is to be understood that the drawing shows only an example provided solely as a practical demonstration of the invention, and that this invention may be varied in its forms and dispositions without departure from the scope of the guiding concept of the invention. Any presence of reference numbers in the attached claims has the purpose of facilitating the reading of the claims with reference to the description and to the drawing, and does not limit the scope of protection represented by the claims.

I claim:

1. A device for closing the initial end of a knitted article directly on one of a circular knitting and a circular stocking machine with a needle cylinder which can form a portion of fabric in the form of a pocket with narrowing sections and widening sections along an arc of working needles of approximately 180°, the device comprising:

a push rod with a pick-up hook at the end;

a push rod movement mechanism adjacent to the internal wall of the needle cylinder, to move said push rod in an axial plane of symmetry to engage, by means of the pick-up hook in an intermediate portion, courses of an initial partial fabric which has been released by the needles and to bring the initial fabric progressively to a side opposite said arc of working needles with the progressive formation of the fabric of the pocket;

a body in the form of a shaped annular ring, integral with the interior of the needle cylinder, and having a radial slot for said push rod and radial slots in the area opposite said arc of needles;

movable hooks in said radial slots, said movable hooks having pin-shaped appendages which can be moved from a concealed position in the annular ring shaped body to a raised position to make the pin-shaped appendages penetrate into the fabric along the initial partial fabric when the initial partial fabric has been brought by said push rod to a side opposite the arc of working needles, and subsequently to move said initial fabric progressively up to vacant needles which are raised and inserted into said initial fabric to engage the fabric by means of the yarn subsequently picked up by the needles for the formation of the fabric; and means for moving said hooks upward and centrifugally, and subsequently in reverse direction.

2. The device according to claim 1, wherein said push rod movement mechanism comprises a rod movable parallel to the axis of the cylinder, with a pivot for pivoting said push rod, and a hinge for causing the angular movement of said push rod, each of said pivot and said hinge being operated during the rotation of the cylinder by means of forks and grooved rings, and with suitable synchronization to obtain the transfer of an edge of the initial fabric engaged by the pick-up hook of the push rod.

3. The device according to claim 1, wherein the hooks with pin-shaped appendages are shaped differently according to their position with respect to said axial plane of symmetry, so that they move in different and simultaneous trajectories with a simultaneous drive.

4. The device according to claim 3, further comprising:

sliders, said hooks being pivoted on said sliders;

springs and adjustable supports interacting with said hooks to engage the initial fabric correctly with the pin-shaped appendages; and cumulative and selective drive means for driving said sliders during the rotation of the cylinder.

5. The device according to claim 4 wherein said cumulative and selective drive means comprise a ring moved by a fork to act on stubs of all the sliders simultaneously, and cams for the successive raising and lowering of the individual hooks.

6. A process for closing the initial end of a knitted article directly on one of a circular knitting and stocking machine with a needle cylinder which can form, along an are of needles of approximately 180°, a portion of fabric in the form of a pocket with narrowing sections and widening sections, and with a push rod with a pick-up hook at the end, a push rod movement mechanism adjacent to the internal wall of the needle cylinder, to move said push rod in an axial plane of symmetry, a body in the form of a shaped annular ring, integral with the interior of the needle cylinder, and having a radial slot for said push rod and radial slots in the area opposite said arc of needles, movable hooks in said radial slots, said movable hooks having pin-shaped appendages which can be moved from a concealed position in the annular ring shaped body to a raised position, and with means for moving said hooks upward and centrifugally, and subsequently in reverse direction, the process comprising the steps of:

transferring the fabric of the pocket to the area opposite said arc of needles which have formed the fabric of the pocket, wherein the transfer is carried out in two phases comprising:

a first phase, in which the initial edge of said fabric pocket is drawn toward said opposite area; and a second phase, with the penetration of pin-shaped appendages into the fabric along the initial partial edge of the fabric, said edge being moved further up to the needles of the complementary are, which are raised and inserted into the edge and then engage it with the fabric formed by said-needles.

* * * * *